United States Patent [19]

Yada et al.

[11] 4,178,038

[45] Dec. 11, 1979

[54] HEADREST OF TREATMENT TABLE

[75] Inventors: Akio Yada, Uji; Naonobu Tsukada, Joyo, both of Japan

[73] Assignee: Kabushiki Kaisha Morita Seisakusho, Kyoto, Japan

[21] Appl. No.: 886,408

[22] Filed: Mar. 14, 1978

[30] Foreign Application Priority Data

Mar. 15, 1977 [JP] Japan ..... 52/31702[U]

[51] Int. Cl.[2] ..... A47C 1/10

[52] U.S. Cl. ..... 297/391; 297/220

[58] Field of Search ..... 297/220, 391, 459

[56] References Cited

U.S. PATENT DOCUMENTS

| | | | |
|---|---|---|---|
| 1,844,576 | 2/1932 | Heintz | 297/220 |
| 2,997,338 | 8/1961 | Mirow | 297/220 |
| 3,156,500 | 11/1964 | Kerr | 297/391 |
| 3,647,260 | 3/1972 | Grant et al. | 297/459 X |

*Primary Examiner*—James C. Mitchell

*Attorney, Agent, or Firm*—Koda and Androlia

[57] ABSTRACT

This invention relates to a headrest for a medical treatment table wherein the headrest comprises a rigid headrest base and a main headrest body of a cushionlike mass of soft material and replacement or washing of the headrest when stained or damaged is facilitated by at least an exterior portion of the main headrest body of a cushionlike mass of soft material being made detachable with respect to the headrest base and wherein the head of a patient is more comfortably rested on the headrest by the center recess being formed in the main headrest body and gently raised portions being formed on the left and right of the recess and the circumferential edge of the headrest is made thin and flat to increase a range of operation within which an operator handles materials such as instruments, drugs, etc.

4 Claims, 5 Drawing Figures

HEADREST OF TREATMENT TABLE

BACKGROUND OF THE INVENTION

1. Field of the Invention

This invention relates to a headrest of a medical treatment table and more particularly to improvements in a medical treatment table comprising a rigid headrest base and a main headrest body formed of a cushionlike mass of soft material adapted to rest the head of a patient comfortably thereon.

2. Description of the Prior Art

As well known, this kind of headrest is attached to a chair type or a bed type treatment table so as to permit the comfortable resting of a patient's head thereon. The conventional type headrest for use in a dental treatment table, as shown for example in a schematic perspective view in FIG. 1(A), is attached to a backrest a of the treatment table through an attachment member b. This headrest, as shown in a sectional view in FIG. 1(B) taken along the line A—A in FIG. 1(A), is inseparably fastened and assembled of a headrest base c and a cushionlike mass of soft material d as an interior member integrally connected to the base c along the flat configuration thereof, and a leather material e in the form of a surface cover integrally connected to and covering the cushionlike mass of soft material d. Accordingly, when the leather material e is stained with cosmetics and/or medicines or damaged by use, it becomes necessary to detach the whole headrest from the treatment table to wash or replace it. The work for detaching the headrest is troublesome, and when it is replaced, it is quite uneconomical to go so far as to replace with new ones the headrest base c and cushionlike mass d when they can bear further use, and moreover when a user has failed to obtain an intended replacement part against his expectation, treatment has had to be interrupted until he had acquired a replacement. A dentist has had to suffer the disadvantages of the kine described above.

And as shown in FIGS. 1(A) and 1(B), the conventional type headrest is substantially U-shaped in cross-section or arcuate in cross-section (not shown) and provides comfort, to be sure, because of its cushionlike material d, but leaves much to be desired because it makes it difficult to keep the patient's head secure on the headrest body and also because the rear neck region of the patient does not come into firm contact with the headrest.

And furthermore, the conventional headrest, as can be seen from FIGS. 1(A) and 1(B), is thick on the circumferential edge because it is provided on the edge portion with raised portions for clamping the patient's head by the lateral sides, and accordingly when the dentist operates with a material in hand, this thick circumferential edge reduces the range of his operation.

SUMMARY OF THE INVENTION

This invention has for its object the removal of the disadvantages and problems described above by providing a simple way of detaching necessary members of the headrest without detaching the whole of the headrest from a treatment table during washing or replacement.

And the invention is further directed to the replacement of only necessary members with new ones in an economical and wasteless manner.

And the invention has for its further object the provision of an easy way of washing so as to permit the washing of only necessary members of the headrest when it becomes necessary to wash the headrest.

In addition thereto, it is another object of the invention to make it possible for a patient to rest his head on the headrest comfortably and without the head being shaken during treatment.

It is yet another object of the invention to make the circumferential edge of the headrest thin in width and enlarge a range of operation in which the dentist handles materials during treatment.

The object of acquiring easy ways of washing and replacing of the objects described above can be achieved by separating a main headrest body of a cushionlike mass of soft material from a rigid headrest base in such a manner that the main headrest body further comprises an interior member and a surface cover and that both the member and the cover are made integral and inseparable or are made separable so as to bring only those members of the headrest body necessary for replacement or washing into a detachable relation with respect to the headrest base. And an attempt to make the head of a patient comfortably and unshakably rested on the headrest is realized by forming a center recess in the interior member of the main headrest of a cushionlike mass of soft material and also forming raised portions on the left and right of the recess and additionally curving the end sides of neck sides of the headrest base rearwards.

Also, an increase in the range of operation in which the operator handles materials is attained by reducing the thickness of the circumferential edge of the headrest.

A description will now be given of an embodiment of the invention by way of example only with reference to the accompanying drawings.

DETAILED DESCRIPTION OF THE PREFERRED EMBODIMENT

Figure 1A:
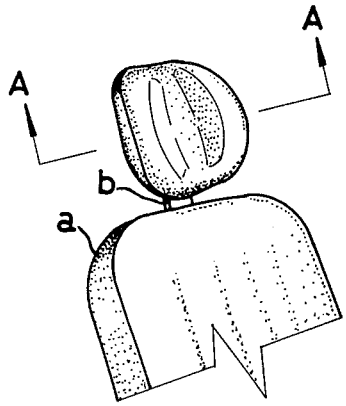
Fig. 1(A) (Prior Art)
FIG. 1(A) is a schematic perspective view of a conventional type headrest.
Figure 1B:
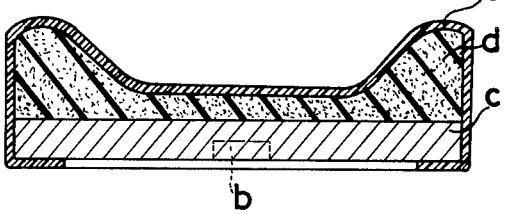
Fig. 1(B) (Prior Art)
FIG. 1(B) is a sectional view taken along the line A—A of the headrest in FIG. 1(A)
Figure 2:
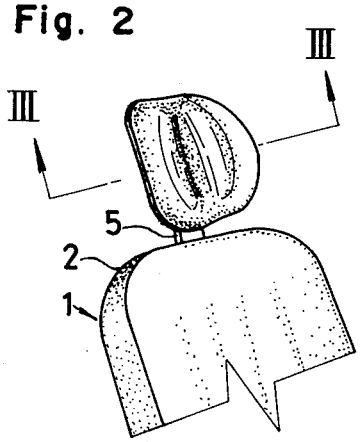
FIG. 2 is a perspective view of the headrest according to the invention.
Figure 3:
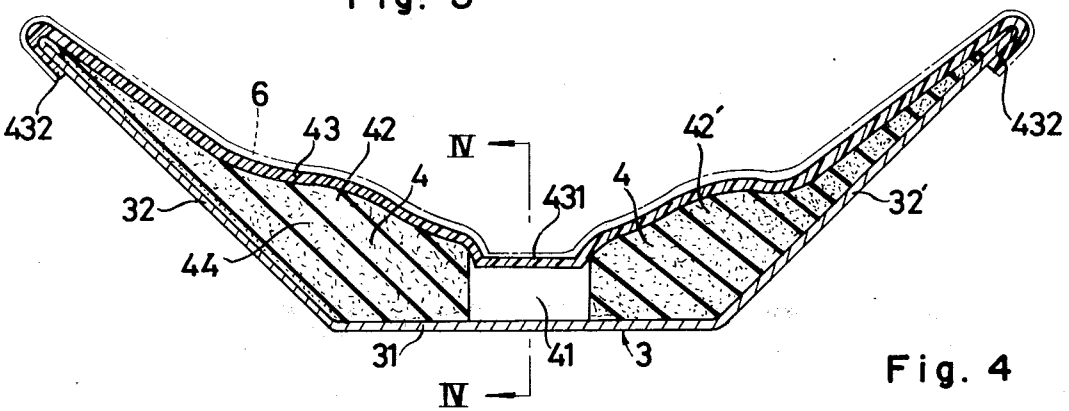
FIG. 3 is a longitudinal sectional view taken along the line III—III of the headrest in FIG. 2.
Figure 4:
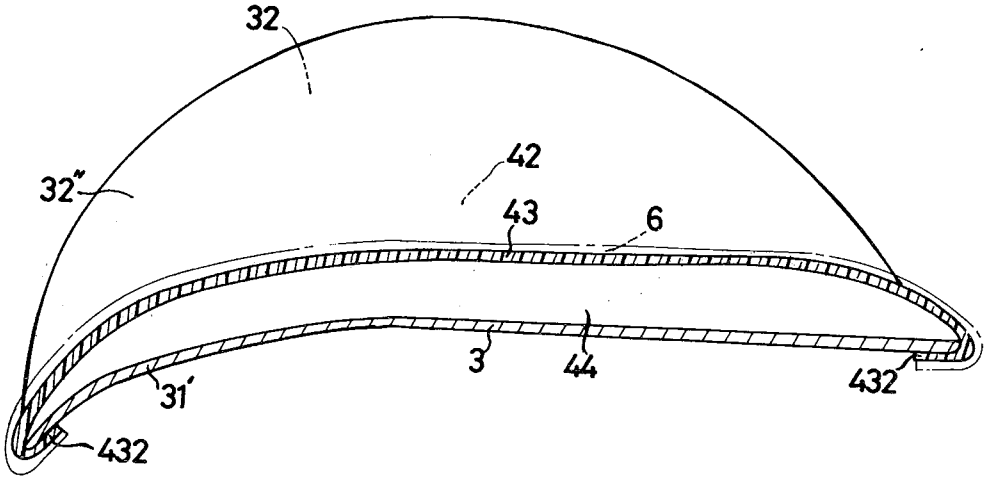
FIG. 4 is a sectional view taken along the line IV—IV of the headrest of FIG. 3.

A headrest according to an embodiment of the invention in FIGS. 2, 3 and 4 is constructed detachably in such a manner that the whole of a main headrest body 4 is made of a cushion-like mass of soft material or at least the exterior part of the body 4 is detachably mounted to a headrest base 3. The headrest 3 illustrated is made of a metal plate channel-shaped in section taken along the line III—III in FIG. 2. More particularly, the headrest base 3 is of a construction wherein the base includes a centrally flat bottom plate 31 and side pieces 32, 32' extending upward in an inverted-bell shape from either side of the bottom plate 31 and wherein the end area 31' of the bottom plate 31 and the end area 32'' of the side pieces 32, 32' are gently curved rearwards in the manner that, when the patient rests his head on the headrest, the rear neck region of the patient can come into contact with the headrest. The main headrest body 4 comprises an interior member 44 of synthetic resin rubber and other rubber based cushionlike material and an extensible surface cover 43 as an exterior member. There are two types of the integral connection of the interior member 44 and surface cover member 43 to each other; one being the case wherein the interior member 44 is connected inseparably as one body to the cover 43 by use of an adhesive agent and the other being the case wherein the interior member 44 is separably connected to the cover 43. In the former case, the interior member 44 and the cover 43 are together detachable with respect to the headrest base 3, while in the latter case, the interior member 44 is adhered to the headrest base 3, and the cover alone is made detachable with respect to the interior member 44 and headrest base 3 which are inseparably connected together into one integral body. In the construction illustrated as an example of a detachable construction a base attachment piece 432 U-shaped in section extends over the whole of the circumferential edge of the extensible elastic surface cover 43, and the attachment piece 432 can simply be attached to or detached from the whole of the circumferential edge of the headrest 3 by hand. Furthermore, the size of the U-shaped cross-section of the attachment piece is either substantially equal to or preferably slightly less than the thickness of the headrest base 3 so as to make use of its extensibility to bring the attachment piece into firm contact with the circumferential edge of the headrest base 3. In the embodiment shown, the interior member 44 of the main headrest body 4 is provided with a center recess 41 and gently raised portions 42, 42' formed on the left and right of the recess 41 so as to rest the head of the patient comfortably on the headrest. The extensible cover 43 is formed with a center recess 431 which is adapted to lie closely along the interior member 44 and to be fitted in the center recess 41 of the interior member 44. As described above, the cover 43 is provided over the entire circumferential end edge with a base attachment piece 432 U-shaped in cross-section. As shown in one-dotted line in FIGS. 3 and 4, there is shown a case wherein another cloth cover 6 is placed over the surface cover 43.

In order to attach the headrest of the invention which has been described above to a backrest 2 of the dental treatment table 1 shown in FIG. 2, the headrest is attached to the back-rest 2 in the manner that the one end of an attachment member 5 is attached to the bottom 31 of the headrest base 3 and then the other end of the attachment member 5 is secured to the backrest 2.

The function and effect of the headrest according to the invention will now be described below. In the headrest of the invention, the main headrest body 4 is either inseparably or separably formed of the interior member 44 and cover 43, and the whole of the main headrest body or part thereof, such as the surface cover, is made detachable with respect to the headrest base 3, and accordingly even if the main headrest body 4 gets stained with cosmetics or chemically damaged, the cover alone with the headrest base 3 left attached to the backrest can be washed or replaced, or even if the cover 43 and the interior member 44 are made inseparable from each other, the main headrest body 4 alone can be washed or replaced. Accordingly, the headrest of the invention makes the washing or replacement more simple and when it is desired to replace the headrest, all that is necessary is to replace the whole of the headrest body or the cover 43 alone, with the result that the headrest of the invention is more economical than the conventional type headrest which requires replacement of the whole headrest.

In the invention, since the interior member 4 is formed with the center recess 41 and gently raised portions 42, 42' are formed on the right and left of the recess 41, the head of the patient is resiliently received on the raised portions and comes into the center recess 41 and also the ends of the interior member on both sides of the center recess 41 are pressed slightly downwards by the load of the head and simultaneously therewith the left and right raised portions 42, 42' converge toward the center, whereby the head is lightly clamped by the left and right raised portions so that the head is not shaken but is positively fixed steadfastly to the headrest to facilitate a treatment operation.

Also, because the bottom plate 31 and the end portions of side pieces 32, 32' of the headrest base 3 are gently curved rearwards, the back neck of the patient bears closely against the curved portion. In addition thereto, because it is only necessary to secure the attachment piece 432 to the circumferential end edge located away from the raised portions 42, 42' by utilizing the extensibility of the cover 43, the headrest is allowed to be reduced in its thickness of the circumferential end portions, with the result that an increase in the operator's sphere of manual operation in tooth, ear and throat, and eye treatment fields reduces a possibility of the material and drug in his hand happening to strike against the headrest.

As apparent from the description so far given, the invention is effective for bringing about advantages such as the ease with which the headrest is replaced or washed, the economy with which replacement is made, the comfortableness and fixedness with which the head of the patient is rested on the headrest, and an increased sphere of manual operation within which the operator can move his hand.

We claim:

1. A headrest for a medical treatment table comprising:

a rigid headrest base, said base comprising:

a flat bottom plate;

at least two side pieces extending upwardly in an inverted-bell shape from both sides of said flat plate;

an end area of said flat bottom plate gently curved rearwardly; and an end area of said side pieces gently curved rearwardly adjacent said end area of said flat bottom plate;

a cushion member coupled to said rigid headrest base; and an extensible surface cover separate from said cushion member and detachably coupled to said rigid headrest base by U-shaped base attachment members integrally formed in said surface cover for covering said cushion member whereby said surface cover may be easily replaced when it becomes soiled.

2. A headrest according to claim 1 further comprising a central recess provided in said cushion member and a central recess formed in said surface cover such that said central recess of said surface cover fits said central recess of said cushion member.

3. A headrest according to claim 2 wherein said surface cover is made from an elastic material and said cushion member is a synthetic resin rubber.

4. A headrest according to claim 3 further comprising a paper cover provided over said surface cover.

* * * * *